United States Patent [19]

Eales

[11] 4,126,427

[45] Nov. 21, 1978

[54] COAL GASIFICATION PLANT

[75] Inventor: David F. Eales, Kinneswood, Scotland

[73] Assignee: British Gas Corporation, London, England

[21] Appl. No.: 774,942

[22] Filed: Mar. 7, 1977

[30] Foreign Application Priority Data

May 28, 1976 [GB] United Kingdom ..... 22297/76

[51] Int. Cl.[2] ..... B01J 3/00

[52] U.S. Cl. ..... 48/62 R; 48/73; 48/77; 48/76; 48/DIG. 2; 110/165 R

[58] Field of Search ..... 110/28 P, 165 R; 48/62 R, 73, 77; 431/175

[56] References Cited

U.S. PATENT DOCUMENTS

| | | | |
|---|---|---|---|
| 1,452,045 | 4/1923 | Hawley | 110/28 P |
| 1,920,186 | 8/1933 | Carter | 431/175 |
| 2,222,822 | 11/1940 | Hordensson | 431/175 |
| 2,777,512 | 1/1957 | Johnson et al. | 431/175 |
| 3,117,619 | 1/1964 | Lange et al. | 431/175 |
| 3,437,561 | 4/1969 | Squires | 48/77 |
| 3,542,501 | 11/1970 | Jones et al. | 431/258 |
| 3,957,458 | 5/1976 | Squires | 48/73 |
| 3,963,443 | 6/1976 | Bohd et al. | 431/175 |

FOREIGN PATENT DOCUMENTS

| | | | |
|---|---|---|---|
| 266,180 | 9/1964 | Australia | 48/76 |

*Primary Examiner*—Carroll B. Dority, Jr.
*Attorney, Agent, or Firm*—Larson, Taylor and Hinds

[57] ABSTRACT

A slagging gasifier incorporating a main burner ignition system which is mounted remote from the main burner thus avoiding damage to the system from over heating and slag dribble. The system comprises a stainless steel tube and a surface ignition ignitor and, in use, neat gas under high pressure is fed into the tube for ignition within the slagging gasifier.

3 Claims, 2 Drawing Figures

COAL GASIFICATION PLANT

Figure 1:
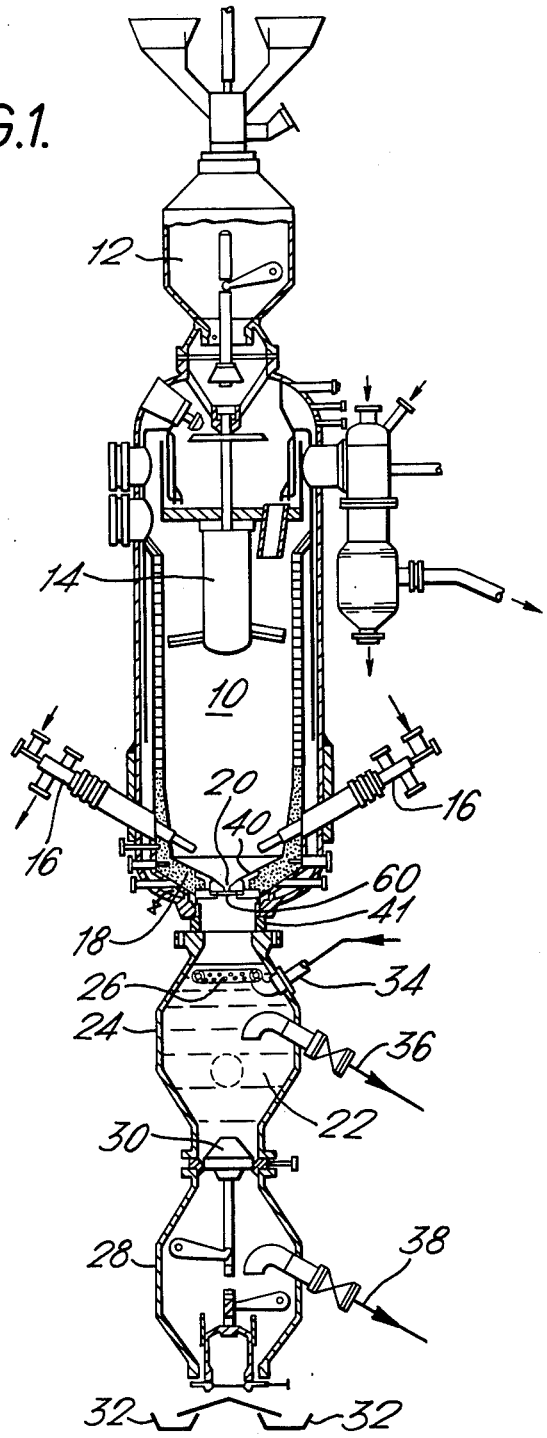

This invention relates to coal gasification plant, and more particularly to an ignition system for igniting a burner for use in a slagging coal gasifier of the kind (hereinafter referred to as the kind specified) in which coal or other carbonaceous fuel is introduced into the top of a column-like gasifying vessel and is gasified under high pressure and temperature by means of oxygen and steam introduced near to the fuel bed through tuyeres. The residual ash collects as a molten slag and iron in the hearth of the gasifier vessel from which is periodically discharged (commonly known as slag tapping) downwardly through a slag tap outlet or orifice in the hearth into water contained in a quenching chamber. Usually, the pool of molten slag and iron is maintained in the hearth by directing hot combustion products from a burner located beneath the slag tap orifice up the tap orifice to retain the slag and iron in the hearth, the tapping of the molten slag and iron being initiated and controlled by stopping or reducing the burner output and reducing the pressure in the quenching chamber by controlled venting to atmosphere through a venting system so as to produce a differential pressure between the quenching chamber and the gasifier vessel.

Examples of such slagging gasifier plant are those disclosed in United Kingdom patent specification No. 977,122 and the Gas Council Research Communication Nos. GS 50 and GS 112.

Difficulties have arisen in such plants in that the ignition systems for igniting the burner so that the burner can direct hot combustion products upwardly through the tap orifice explained above, were fixed and placed close to the burner nozzle and, therefore, were prone to corrosion because during a slag tapping operation, molten slag dropped onto the system and this led to corrosion. Furthermore, the ignitors do not operate satisfactorily when over-heated.

It is an object of the invention to provide an improved ignition system for use in a slagging gasifier less subject to the aforesaid disadvantages.

According to the invention there is provided a slagging gasifier of the kind specified hereinbefore, wherein there is provided a burner ignition system comprising a neat gas nozzle burner, a gas supply tube passing through the wall of said quench chamber and connected to said nozzle burner, and an ignitor positioned adjacent the nozzle of said neat gas nozzle burner, the arrangement being such that in use gas is fed at a pressure between 50 and 200 psi such that upon ignition, a long flame issues from the neat gas burner which is directed towards the main burner for ignition or re-ignition thereof.

Preferably, the ignition source is a surface ignition source.

Also, preferably, the fuel gas carrying tube is of stainless steel having an internal diameter of between $\frac{1}{8}$ - $\frac{1}{4}$ inch.

Figure 2:
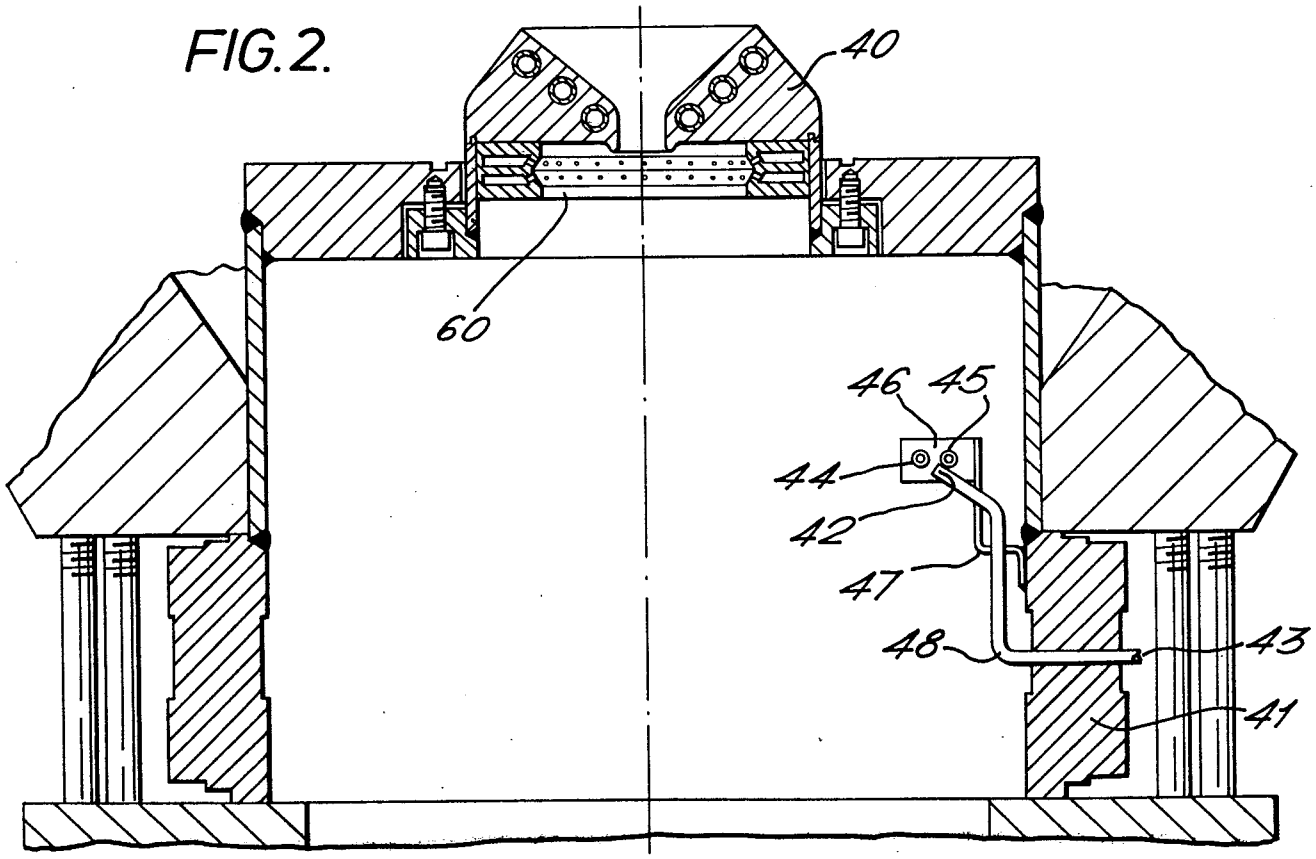

To enable the invention to be more closely understood, and solely by way of example, an embodiment of the invention will now be described with reference to the accompanying diagrammatic drawings in which:

FIG. 1 is a sectional side elevation of a fixed-bed slagging gasifier of the kind specified hereinbefore, and FIG. 2 is an enlarged sectional side elevation of part of the gasifier shown in FIG. 1 showing an ignition system assembly for use in the gasifier.

Referring first to FIG. 1, the gasifier has a refractory-lined pressurised gasification chamber 10 into which coal is fed from a lock hopper 12 and distributed by rotatable distributor means 14. Oxygen and steam are introduced into the fuel bed (not shown) through tuyeres 16 to promote gasification of the coal. In use of the gasifier, a reservoir or pool of molten slag and iron collects on the sloping hearth 18 and is periodically passed, through an orifice formed in a removable slag tap 40 supported within the hearth 18, into a water reservoir 22 contained in a quenching chamber 24 where it is rapidly quenched in a region of turbulent water issuing from a perforated tubular ring 26 before being transferred to a lock hopper 28 in a form of a dense small-grained frit entrained with some of the quenching water upon operation of a valve 30. The frit is discharged from the lock hopper 28 onto moving conveyors 32. Water supplied to the tubular ring 26 through an inlet 34 may partly be water recirculated through outlet 36, 38 from the quenching chamber and slag lock hopper 24, 28 respectively, by pump and filter means (not shown).

The quenching chamber 24 is secured in a gas-tight manner to the bottom of the gasifier chamber 10 through the intermediary of a sandwich flange assembly 41. A nozzle mixing burner 60, together with the slag tap 40 is supported by the annular flange assembly 41, but is arranged to be readily removable therefrom.

Referring now to FIG. 2, the ignition system assembly comprises a shaped stainless steel tube 48 shaped so that the end 42 of the tube 48 forms a 45° angle with the vertical centre line running through the slag tap orifice 20. The stainless steel tube 48 is mounted within the sandwich flange 41 and passes through it so as to form a gas inlet 43. Two surface ignition ignitors 44, 45 are mounted adjacent to the end 42 of the stainless steel tube 41 on a mounting 46 which is fixed by an arm 47 on to the sandwich flange 41.

In use of the gasifier, assuming the burner needs to be ignited either at the start of a gasification process or the burner has unintentionally been allowed to go out and has to be re-ignited, lean gas at 100 psi is fed into the inlet 43 and is ignited at the end 42 of the stainless steel tube 48 by either of the ignitors 44, 45. Only one ignitor is used, although both are connected electrically (not shown), one surface ignition ignitor is used as a spare. When the lean gas has been ignited a long stable pencil-like flame is produced which can ignite the burner 60.

Known types of ignition systems are usually mounted close to the burner and are thus subject to attack by the molten slag which either drips through the slag tap orifice or during a slag tapping operation and thus leads to malfunctioning of the known systems.

The advantage of the present system is that it is removed from any slag dribble or slag during a slag tapping operation and, therefore, does not suffer from attack by the molten slag and iron.

And yet a further advantage of the present ignition system is that with the system being located away from the burner 60, the system does not suffer from overheating.

We claim:

1. A slagging gasifier of the kind in which coal or other carbonaceous fuel is introduced into the top of a column-like gasifying vessel and is gasified under high pressure and temperature by means of oxygen and steam introduced near the fuel bed through tuyeres, a residual ash collecting as a molten slag and iron in the hearth of the gasifier vessel from which it is periodically discharged downwardly through a slag tap orifice in the hearth into water contained in a quenching chamber, the molten slag and iron being maintained molten in the hearth by directing hot combustion products from a main burner up the slag tap orifice, said main burner comprising an annular ring positioned beneath and surrounding said slag tap orifice, the improvement wherein there is provided a main burner ignition system located at a position in said quench chamber remote from said main burner and comprising a neat gas nozzle burner, a gas supply tube passing through a wall of said quench chamber and connected to said nozzle burner, and an ignitor positioned adjacent the nozzle of said neat gas nozzle burner, said gas nozzle burner being located below said main burner and out of the way of slag which passes through said slag tap orifice, the arrangement being such that in use, neat gas is fed to the nozzle burner such that, upon ignition, a long flame issues from the nozzle burner which is directed towards the main burner for igniting or re-igniting thereof.

2. A slagging gasifier according to claim 1, wherein the ignitor comprises an electrical ignitor.

3. A slagging gasifier according to claim 1, wherein the gas supply tube comprises a stainless steel tube having an internal diameter of about $\frac{1}{8}$ – $\frac{1}{4}$ inch, said gasifier further including means for feeding neat gas at a pressure of between 50 and 200 psi to said neat gas burner.

* * * * *